US007111417B1

(12) United States Patent
Bartlett

(10) Patent No.: US 7,111,417 B1
(45) Date of Patent: Sep. 26, 2006

(54) EARTH HANDLING APPARATUS OPERABLE BY AN ALL TERRAIN VEHICLE (ATV)

(76) Inventor: Jerrold R. Bartlett, 420 County Road #303, Parachute, CO (US) 81635

( * ) Notice: Subject to any disclaimer, the term of this patent is extended or adjusted under 35 U.S.C. 154(b) by 0 days.

(21) Appl. No.: 11/122,904

(22) Filed: May 6, 2005

(51) Int. Cl.
*E02F 3/60* (2006.01)
*E01H 4/00* (2006.01)
*E01H 5/06* (2006.01)

(52) U.S. Cl. ..... 37/231; 37/268; 37/399; 172/684.5

(58) Field of Classification Search ..... 37/399, 37/231, 268, 269; 172/684.5
See application file for complete search history.

(56) References Cited

U.S. PATENT DOCUMENTS

| | | | |
|---|---|---|---|
| 3,449,845 | A | 6/1969 | Jessen et al. |
| 3,934,362 | A | 1/1976 | Hyler |
| 3,969,835 | A | 7/1976 | Erdelyan |
| 4,071,965 | A | 2/1978 | Lee |
| 4,336,663 | A | 6/1982 | Moberly |
| 4,630,686 | A | 12/1986 | Ausmus, Jr. |
| 4,898,247 | A | 2/1990 | Springfield |

*Primary Examiner*—Christopher J. Novosad
(74) *Attorney, Agent, or Firm*—Norman B. Rainer

(57) ABSTRACT

An earth handling apparatus operable in a trailered manner behind an ATV includes a rolling framework containing a tiltable accumulating bowl having a pivotable front door. Winch devices operated by the electrical system of the ATV control the tilting of the framework, the bowl and the front door to enable the bowl to accumulate, transport and controllably discharge earth, sand, gravel, snow or other surface substrate.

10 Claims, 5 Drawing Sheets

EARTH HANDLING APPARATUS OPERABLE BY AN ALL TERRAIN VEHICLE (ATV)

BACKGROUND OF THE INVENTION

1. Field of the Invention

This invention concerns apparatus for handling earth and related substrates such as gravel and snow by way of scraping, leveling and transporting operations, and more particularly relates to earth handling apparatus adapted for use in small or confined areas.

2. Description of the Prior Art

Various types of large scale industrial earth handling machines are widely employed in operations such as highway and airfield construction, land clearing, and various digging, filling and grading procedures. The soil-contacting components of the apparatus are either incorporated into a wheeled vehicle or are trailered behind a towing vehicle. The very large size and considerable cost of such equipment causes ownership and operation to be affordable only by large corporations.

In earth moving operations on small farms, and applications involving bicycle trails, residential landscaping, forest trails, walking paths and golf courses, relatively small, highly maneuverable equipment is necessary, and its cost must be affordable for ownership by private parties or small municipalities.

All terrain vehicles (ATV) are widely employed for recreational and work purposes, and have been used to trailer carts in confined areas requiring high maneuverability. However, manipulative interaction between the ATV and a towed unit has been minimal.

It is accordingly an object of the present invention to provide a relatively inexpensive small earth handling apparatus which can be trailered behind an ATV and operated by controls associated with said ATV.

It is another object of this invention to provide in combination a small earth handling apparatus towable by an ATV, and control means installable onto said ATV for manipulating said apparatus.

These objects and other objects and advantages of the invention will be apparent from the following description.

SUMMARY OF THE INVENTION

The above and other beneficial objects and advantages are accomplished in accordance with the present invention by an earth handling apparatus operated by an ATV, said apparatus comprising:

a) a rolling framework comprised of elongated rigid front and rear frame members and paired side frame members, said four frame members being joined in a coplanar rectangular configuration defining an interior region and with portions of said side frame members extending as rearward extensions behind said rear frame member, and a trailer hitch bar extending forwardly from the center of said front frame member, b) a wheel journaled to each rearward extension of said side frame members, and adapted to rotate in a vertical plane, thereby supporting said framework for rolling movement upon underlying terrain, c) an accumulating bowl positioned within the interior region of said framework and bounded by floor, rear and paired side retaining surfaces and a front door pivotable between an upper, open state and lower, closed state, said floor surface having a forwardly directed cutting edge, said bowl being supported by said framework by way of pivot means interactive between said side retaining surfaces and corresponding side frame members to permit tilting movement of said bowl in a vertical path parallel to said side frame members, d) tilting means comprised of a first electrically operated winch associated with said front frame member, a rigid boom attached to said front frame member and extending above said bowl, and a pulling cable interactive between said winch and rear retaining surface and guided by said boom to achieve said tilting movement of said bowl between a horizontally disposed state which permits earth to enter and be transported by said bowl, and an obliquely angled state which permits dumping of earth from said bowl, e) a second electrically operated winch for moving said front door to its open state to permit earth to enter said bowl and to its closed state to secure the earth during transport, and f) a third electrically operated winch interactive between said hitch bar and ATV to control the elevation of said bowl above said terrain.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
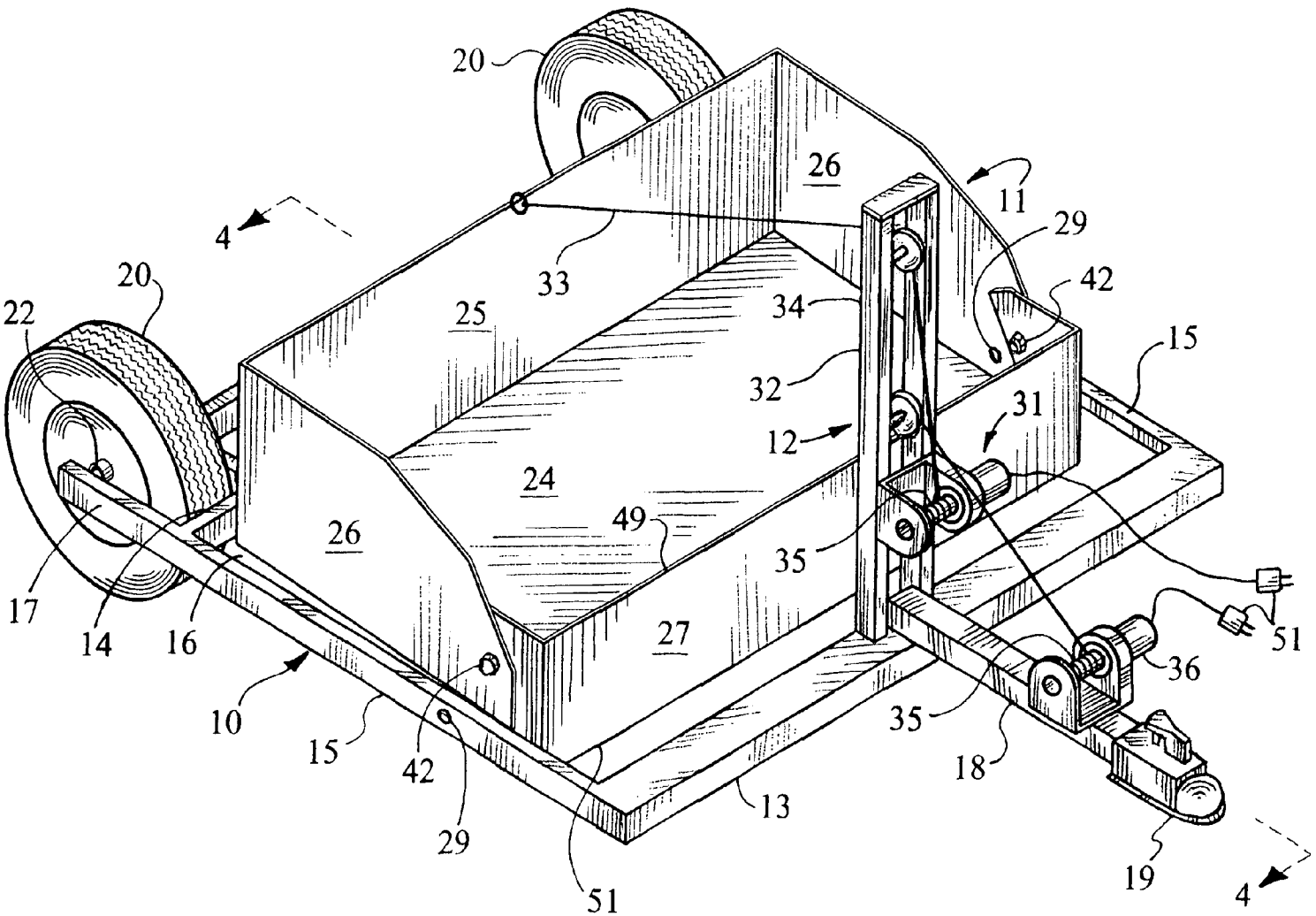
FIG. 1 is a fragmentary top and front perspective view of an embodiment of the earth handling apparatus of the present invention, shown in its transport mode of operation.

Referring now to FIGS. 1–5, an embodiment of the earth moving apparatus of this invention is shown comprised of rolling framework 10 carrying an accumulating bowl 11 which can be tilted in a vertical path, and tilting means 12 interactive between framework 10 and bowl 11.

Framework 10 is comprised of elongated rigid front and rear frame members 13 and 14, respectively, and paired side frame members 15. Said four frame members are shown to be straight and joined in a coplanar rectangular configuration defining an interior region 16. Portions of side frame members 15 extend as rearward extensions 17 behind rear frame member 14. A trailer hitch bar 18 extends forwardly from the center of front frame member 13, and terminates in hitching socket 19.

A wheel 20 is journaled to each rearward extension 17 and adapted to rotate in a vertical plane, thereby supporting the apparatus for rolling movement upon the underlying terrain 21 which may be earth, gravel, snow or ice. The wheels further serve to permit pivoting movement of the framework 10 in a vertical path about the center axles 22 of said wheels.

The diameter of the wheels is a critical factor. In the exemplified embodiment, the wheels must having diameters between 14 and 18 inches in order that framework 10 be substantially horizontally disposed when the apparatus is attached to a towing ATV. Wheels of too small a diameter, may cause the rear portion of the framework to impinge upon a load of soil dumped by the apparatus. Wheels of small diameter also sink undesirably into muddy soil.

Bowl 11 is positioned within interior region 16 of said framework, and is bounded by floor and rear retaining surfaces 24 and 25, respectively, paired side retaining surfaces 26, and front door 27 attached by paired pivot means 42 to said side surfaces 26. Floor surface 24 has a forwardly directed cutting edge 28. The bowl 11 is supported by framework 10 by way of pivot paired pivot pins 29 outwardly directed from side retaining surfaces 26 and interactive with corresponding side frame members 15. By virtue of said configuration and manner of interaction, the bowl is permitted tilting movement in a longitudinal vertical path parallel to said side frame members, as indicated by the curved arrow in FIG. 4. Lateral adjustment means may be employed to permit laterally angled adjustment of the position of the bowl, thereby enabling the apparatus to remove or deposit tapered layers of earth.

Figure 4:
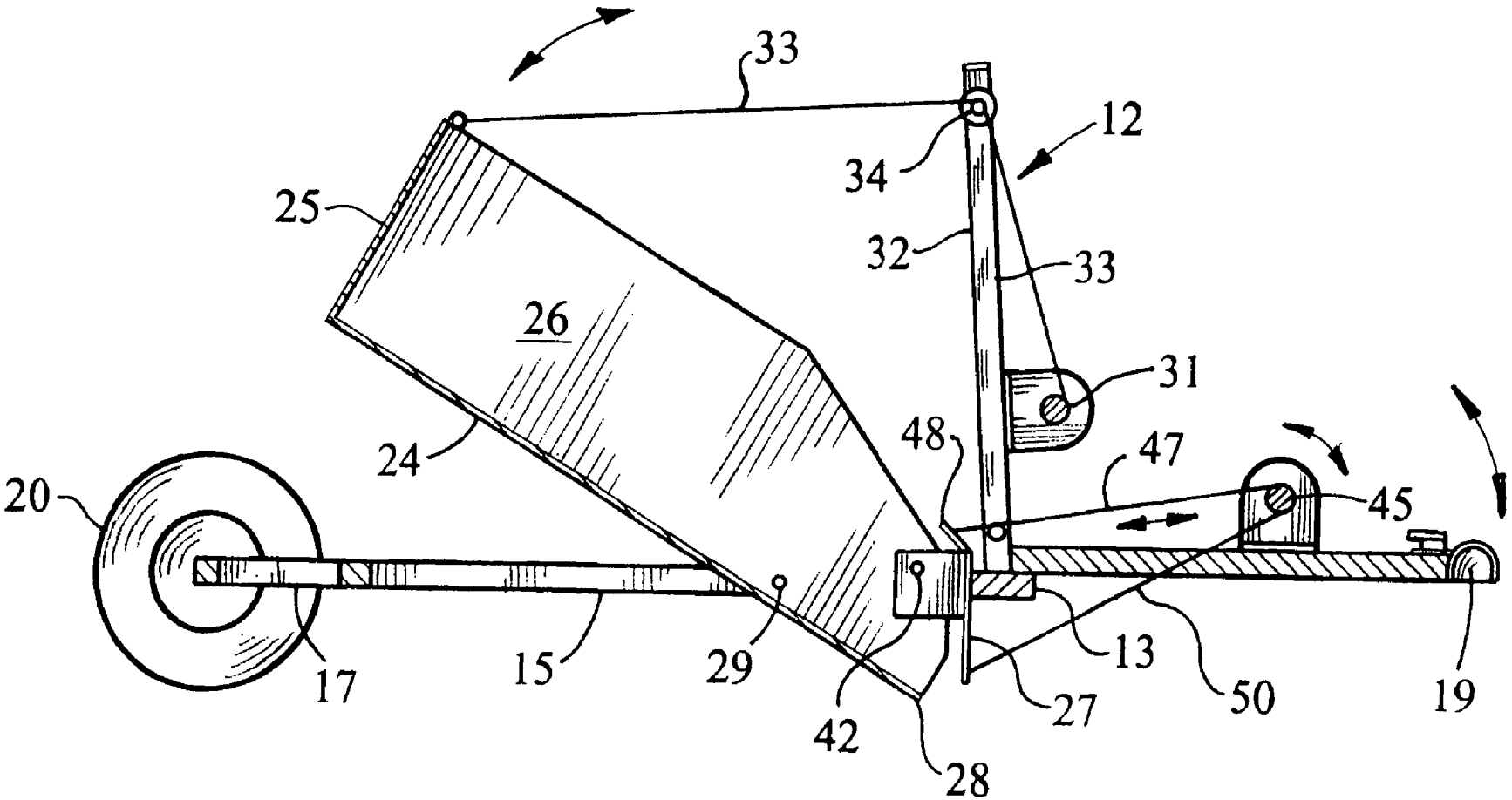
FIG. 4 is a sectional view taken in the direction of the arrows upon the line 4—4 of FIG. 1, and showing the apparatus in its dumping mode of operation.

Tilting means 12 is comprised of a first electrically operated winch 31 and associated spool 35 secured upon rigid boom 32 mounted upon front frame member 13 which extends rearwardly and obliquely above the bowl, and a pulling cable 33 interactive between said spool and rear retaining surface 25. The path of cable 33 is guided by guide means 34 positioned atop boom 32. Said guide means may be a pulley wheel or stationary guide. When winch 31 is activated so as to wind a portion of cable 33 upon spool 35, the bowl is tilted, as shown in FIG. 4. When winch 31 is deactivated, the weight of the bowl causes it to return to its horizontal position.

Front door 27 is opened and closed by the action of second winch 36 comprised of spool 45 driven by reversible motor 46. A first cable 47 extends from spool 45 to lever peg 48 rearwardly directed from the top edge 49 of said front door. A second cable 50 extends from spool 45 to the lower edge 51 of front door 27. By appropriate rotational movement of spool 45, as shown by the arrowed line in FIG. 4, door 27 can be rotated about pivots 42 between its closed position shown in FIG. 1 and its open position, shown in FIG. 4.

Figure 2:
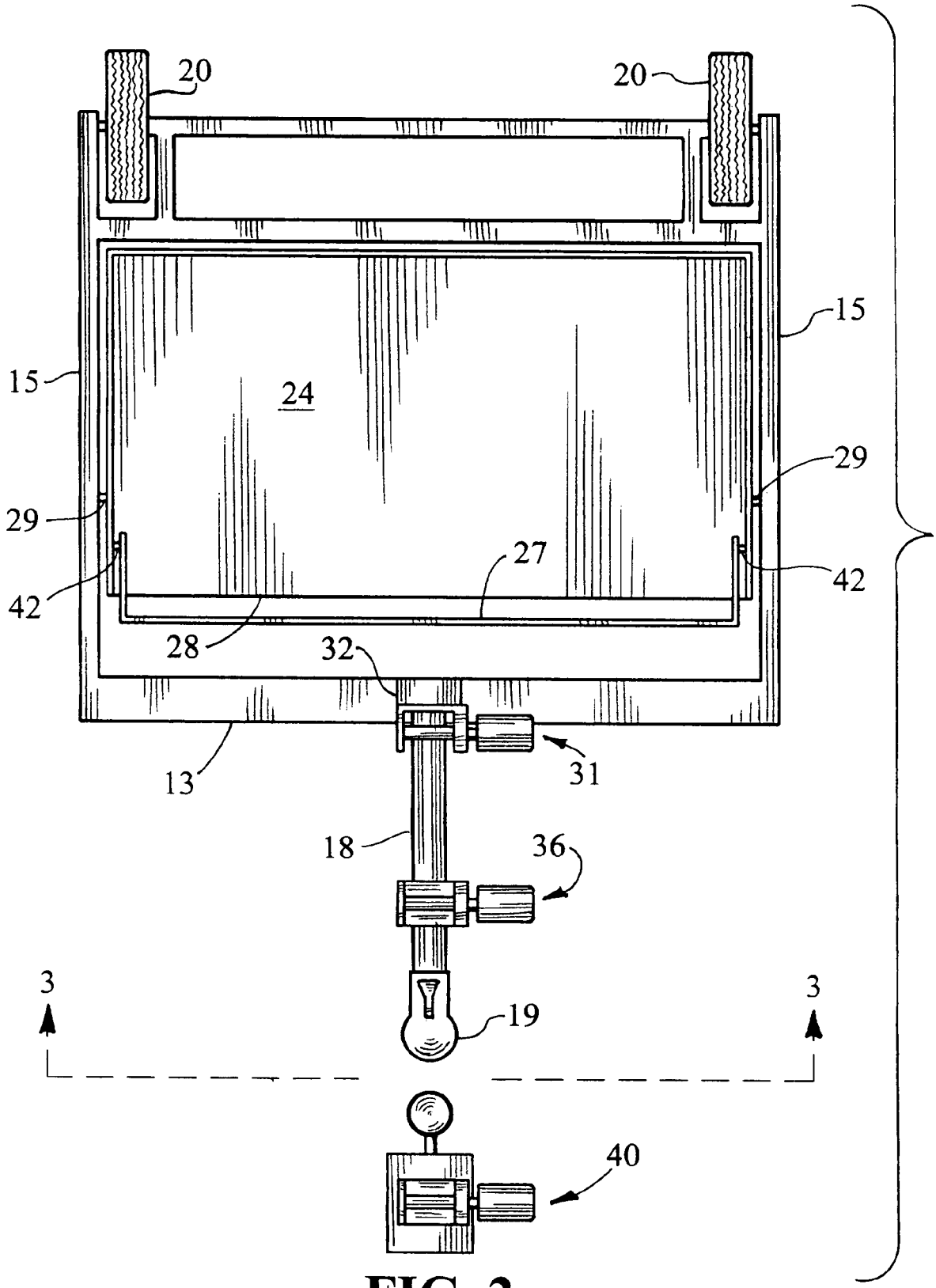
FIG. 2 is a top view of the embodiment of FIG. 1 including a third winch.
Figure 3:
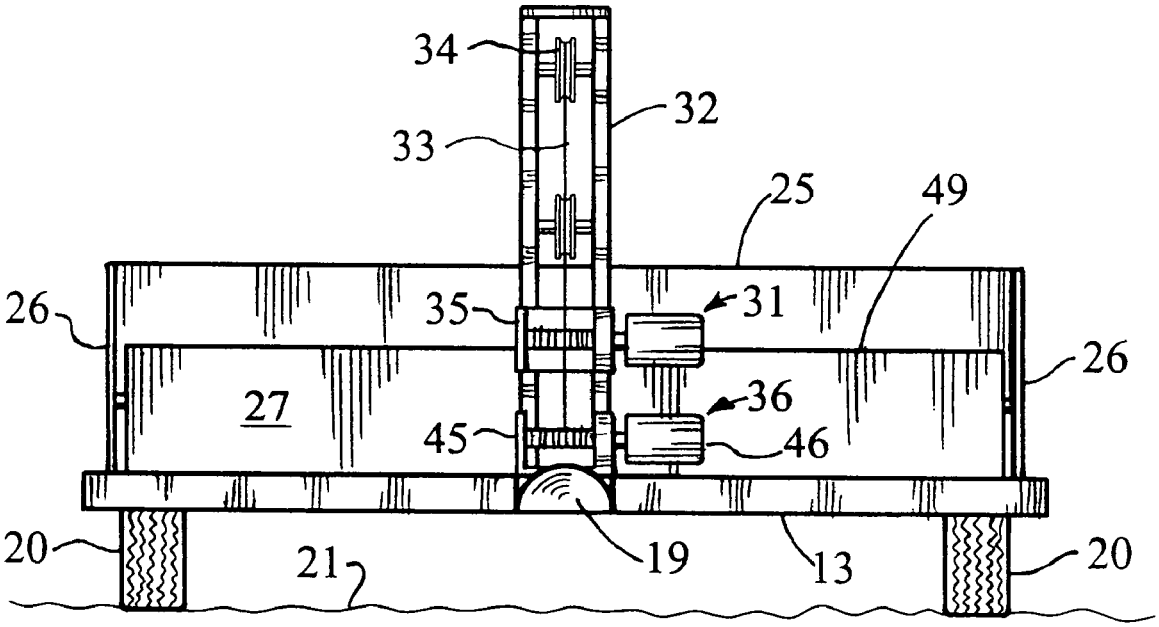
FIG. 3 is a front view taken in the direction of the arrows upon the line 3—3 of FIG. 2.
Figure 5:
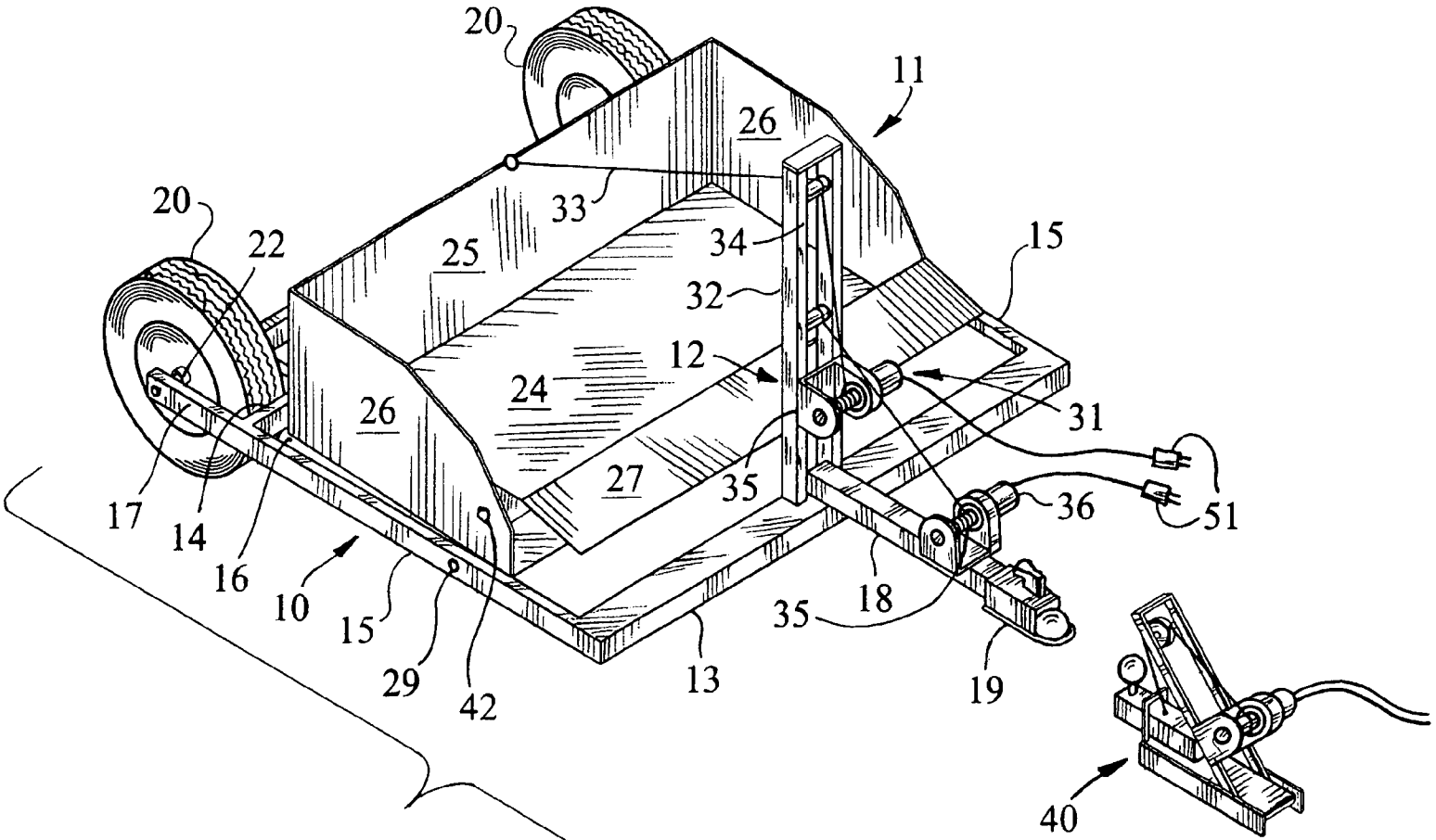
FIG. 5 is an exploded perspective view similar to FIG. 1 including a third winch and showing a loading mode of operation.

FIGS. 2 and 5 show the inclusion of a third electric winch mechanism 40 interactive between the rear of an ATV towing vehicle, and hitching socket 19. Said third winch mechanism is adapted to controllably raise or lower hitch bar 18 with attendant pivoting movement of bowl 11. The raising of said bowl is particularly useful in dumping operations, as shown in FIG. 4. Such action, in conjunction with forward movement of the apparatus, causes the cutting edge to serve as a scraper edge to provide a layer of dumped earth of calibrated thickness. When the bowl is lowered and front door 27 is opened, as shown in FIG. 5, cutting edge 28 engages the earth, causing the earth to enter bowl 11 with forward movement of the ATV. Operational controls for the three winches may be conveniently located upon or adjacent the steering handles of the ATV. Winch motors 31 and 36 are coupled by way of connectors 51 to the electrical system of the ATV.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. An earth handling apparatus operated by an all-terrain vehicle, said apparatus comprising:

a) a rolling framework comprised of elongated rigid front and rear frame members and paired side frame members, said four frame members being joined in a coplanar rectangular configuration defining an interior region and with portions of said side frame members extending as rearward extensions behind said rear frame member, and a trailer hitch bar extending forwardly from the center of said front frame member, b) a wheel axially journaled to each rearward extension of said side frame members, and adapted to rotate in a vertical plane, thereby supporting said framework for rolling movement upon underlying terrain, c) an accumulating bowl positioned within the interior region of said framework and bounded by floor, rear and paired side retaining surfaces and a front door pivotable between an upper, open state and lower, closed state, said floor surface having a forwardly directed cutting edge, said bowl being supported by said framework by way of pivot means interactive between said side retaining surfaces and corresponding side frame members to permit tilting movement of said bowl in a vertical path parallel to said side frame members, d) tilting means comprised of a first electrically operated winch associated with said front frame member, a rigid boom attached to said front frame member and extending above said bowl, and a pulling cable interactive between said winch and rear retaining surface and guided by said boom to achieve said tilting movement of said bowl between a horizontally disposed state which permits earth to enter and be transported by said bowl, and an obliquely angled state which permits dumping of earth from said bowl, e) a second electrically operated winch for moving said front door to said open state to permit earth to enter said bowl and to said closed state to secure the earth during transport, and f) a third electrically operated winch interactive between said hitch bar and said all terrain vehicle to control the elevation of said bowl above said terrain.

2. The earth handling apparatus of claim 1 wherein said hitch bar terminates forwardly in a hitching socket.

3. The earth handling apparatus of claim 2 wherein said wheels further serve to permit pivoting movement of said framework in a vertical path about the axles of said wheels.

4. The earth handling apparatus of claim 3 wherein said wheels are of equal diameters between 14 and 18 inches, thereby causing said framework to be substantially horizontally disposed when said apparatus is attached by way of said hitching socket to said all terrain vehicle.

5. The earth handling apparatus of claim 4 in combination with a removably attached all terrain vehicle.

6. The earth handling apparatus of claim 1 further provided with lateral adjustment means to permit laterally angled adjustment of the position of said bowl, thereby enabling the apparatus to remove or deposit tapered layers of earth.

7. The earth handling apparatus of claim 1 wherein said first electrically operated winch is secured upon said rigid boom.

8. The earth handling apparatus of claim 7 wherein said first, second and third winches include a spool upon which a cable is controllably wound.

9. The earth handling apparatus of claim 8 wherein the spool associated with said second winch is reversibly driven.

10. The earth handling apparatus of claim 8 wherein operational controls for said winches are located upon or adjacent the steering mechanism of said all terrain vehicle.

* * * * *